US009860955B2

(12) United States Patent
Kim et al.

(10) Patent No.: US 9,860,955 B2
(45) Date of Patent: Jan. 2, 2018

(54) LED DRIVING APPARATUS AND LIGHTING APPARATUS INCLUDING SAME

(71) Applicant: SAMSUNG ELECTRONICS CO., LTD., Suwon-si (KR)

(72) Inventors: Hyun Jung Kim, Yongin-si (KR); Bong Jin Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/086,952

(22) Filed: Mar. 31, 2016

(65) Prior Publication Data

US 2017/0064785 A1 Mar. 2, 2017

(30) Foreign Application Priority Data

Sep. 2, 2015 (KR) ..... 10-2015-0124088

(51) Int. Cl.

*H05B 37/00* (2006.01)
*H05B 33/08* (2006.01)
*H05B 37/02* (2006.01)

(52) U.S. Cl.

CPC ..... *H05B 33/086* (2013.01); *H05B 33/0815* (2013.01); *H05B 33/0827* (2013.01); *H05B 33/0845* (2013.01); *H05B 33/0875* (2013.01); *H05B 37/02* (2013.01)

(58) Field of Classification Search

CPC ..... H05B 33/0815; H05B 33/0827; H05B 33/0845; H05B 33/086; H05B 33/0875; H05B 37/02

USPC ..... 315/186, 192, 193, 294, 307

See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |

(Continued)

FOREIGN PATENT DOCUMENTS

| | | | |
|---|---|---|---|
| JP | 2012-99337 | A | 5/2012 |
| JP | 2014-160574 | A | 9/2014 |

(Continued)

*Primary Examiner* — Tung X Le

(74) *Attorney, Agent, or Firm* — Sughrue Mion, PLLC

(57) ABSTRACT

A light emitting diode (LED) driving apparatus includes: a power supply circuit supplying driving power to a first LED group and a second LED group, the first LED group and the second LED group being configured to emit light having different color temperatures; a current controlling circuit controlling a first magnitude of a first current flowing through the first LED group and a second magnitude of a second current flowing through the second LED group; and an LED controller concurrently controlling on/off switching operations of a first LED of the first LED group and a second LED of the second LED group.

19 Claims, 13 Drawing Sheets

(56) References Cited

U.S. PATENT DOCUMENTS

| | | | | |
|---|---|---|---|---|
| 7,288,758 | B2 | 10/2007 | Sherrer et al. | |
| 7,319,044 | B2 | 1/2008 | Han et al. | |
| 7,501,656 | B2 | 3/2009 | Han et al. | |
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,928,670 | B2 * | 4/2011 | Chen | H05B 33/0815 315/159 |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,735,931 | B2 | 5/2014 | Han et al. | |
| 8,766,295 | B2 | 7/2014 | Kim | |
| 8,783,901 | B2 | 7/2014 | Zoorob et al. | |
| 2009/0015172 | A1 * | 1/2009 | Huang | H05B 33/0818 315/246 |
| 2011/0095704 | A1 * | 4/2011 | Moussakov | H05B 33/0815 315/294 |
| 2011/0234122 | A1 * | 9/2011 | Yu | G09G 3/3406 315/297 |
| 2012/0001555 | A1 | 1/2012 | Tu et al. | |
| 2013/0009560 | A1 | 1/2013 | Takeda et al. | |
| 2013/0141014 | A1 | 6/2013 | Rains, Jr. et al. | |
| 2014/0091723 | A1 * | 4/2014 | Kuo | H05B 33/0857 315/200 R |
| 2014/0232270 | A1 | 8/2014 | Kimura et al. | |
| 2014/0253056 | A1 * | 9/2014 | Hu | H02M 3/158 323/205 |
| 2014/0361697 | A1 | 12/2014 | Miskin et al. | |
| 2015/0115816 | A1 * | 4/2015 | Bradford | H05B 33/083 315/192 |
| 2015/0189711 | A1 * | 7/2015 | Horsky | H05B 33/083 315/186 |

FOREIGN PATENT DOCUMENTS

| | | | |
|---|---|---|---|
| JP | 3197202 | U | 4/2015 |
| KR | 10-2012-0135003 | A | 12/2012 |
| KR | 10-1510845 | B1 | 4/2015 |

* cited by examiner

LED DRIVING APPARATUS AND LIGHTING APPARATUS INCLUDING SAME

CROSS-REFERENCE TO RELATED APPLICATION

This application claims priority from Korean Patent Application No. 10-2015-0124088, filed on Sep. 2, 2015 in the Korean Intellectual Property Office, the disclosure of which is incorporated herein by reference in its entirety.

BACKGROUND

Methods and apparatuses consistent with exemplary embodiments relate to a light emitting diode (LED) driving apparatus and a lighting apparatus including the same.

As a semiconductor light emitting device, an LED has low power consumption, a relatively long lifespan, and the ability to emit light having various colors. As a result, LEDs are being used in a wide variety of fields, such as lighting apparatuses, backlight units of display devices, and vehicle headlamps.

An apparatus for driving LEDs may control a variety of luminescent properties, such as color temperature and luminous flux, as well as on/off switching operations of the LEDs. However, existing LED driving apparatuses require a complex configuration to control luminescent properties.

SUMMARY

An aspect of the present inventive concept may provide a light emitting diode (LED) driving apparatus, enabling a control module for LEDs to be simplified, and a lighting apparatus including the same.

According to an aspect of an exemplary embodiment, there is provided a light emitting diode (LED) driving apparatus including: a power supply circuit configured to supply driving power to a first LED group and a second LED group, the first LED group and the second LED group being configured to emit light having different color temperatures; a current controlling circuit configured to control a first magnitude of a first current flowing through the first LED group and a second magnitude of a second current flowing through the second LED group; and an LED controller configured to concurrently control on/off switching operations of a first LED of the first LED group and a second LED of the second LED group.

The current controlling circuit may be further configured to receive a color temperature control signal, and to control the first magnitude and the second magnitude in accordance with the color temperature control signal.

The current controlling circuit may further include: a first resistor electrically connected to the first LED group and a second resistor electrically connected to the second LED group; and a first transistor electrically connected to the first resistor and the first LED group and a second transistor electrically connected to the second resistor and the first LED group, the first transistor and the second transistor being configured to regulate the first current and the second current flowing through the first resistor and the second resistor in response to a control signal, and the current controlling circuit may be further configured to determine a level of the control signal by comparing the first current and the second current to a current corresponding to the color temperature control signal.

The current controlling circuit may further include: a current sensing circuit configured to sense the first current and the second current; a control signal generating circuit configured to generate a first control signal based on the first current sensed by the current sensing circuit and a second control signal based on the second current sensed by the current sensing circuit; and a current regulating circuit configured to receive the first control signal and the second control signal, and regulate the first current in accordance with the first control signal and the second current in accordance with the second control signal.

The LED controller may be further configured to receive a luminous flux control signal, and control a first luminous flux of the first LED group and a second luminous flux of the second LED group based on the luminous flux control signal.

The LED controller may further include at least one common control switch configured to simultaneously change on/off switching operations of the first LED and the second LED.

The LED driving apparatus may further include a first plurality of diodes electrically connected between the first LED group and the LED controller.

The LED controller may be further configured to sequentially control at least a first plurality of LEDs included in the first LED group and a second plurality of LEDs included in the second LED group according to a corresponding order of the first plurality of LEDs and the second plurality of LEDs, and simultaneously control on/off switching operations of LEDs of the first LED group and the second LED group having an identical order.

A first quantity of the first plurality of LEDs may be identical to a second quantity of the second plurality of LEDs, and the LED controller may be further configured to control on/off switching operations of the first LED together with on/off switching operation of the second LED group.

According to an aspect of another exemplary embodiment, there is provided a lighting apparatus including: a light source including a first LED array and a second LED array of a plurality of LED arrays configured to emit light having different color temperatures, each of the plurality of LED arrays including a corresponding plurality of LEDs sequentially connected to each other in series; a power supply circuit configured to rectify power received from an alternating current (AC) power source and supply driving power to the plurality of LED arrays; a current controlling circuit configured to control a first magnitude of a first current flowing through the first array and a second magnitude of a second current flowing through the second array; and an LED controller configured to concurrently control on/off switching operations of a first LED of the first LED array and a second LED of the second LED array.

The lighting apparatus may further include a substrate on which the plurality of LED arrays are mounted.

The first LED array may be configured to emit light having one of a maximum color temperature, an intermediate color temperature, and a minimum color temperature; and the second LED array may be configured to emit light having a color temperature different from a color temperature of the first LED array.

The current controlling circuit may include: a current sensing circuit configured to sense a first current flowing through the first LED array and a second current flowing through the second LED array; a control signal generating circuit configured to generate a first control signal based on the first current sensed by the current sensing circuit and a second control signal based on the second current sensed by the current sensing circuit; and a current regulating circuit configured to receive the first control signal and the second control signal, and regulate the first current in accordance with the first control signal and the second current in accordance with the second control signal.

The LED controller may include at least one common control switch configured to simultaneously control on/off switching operations of the first LED and the second LED, and may be further configured to receive a luminous flux control signal and control a first luminous flux of the first LED array and a second luminous flux of the second LED array based on the luminous flux control signal simultaneously.

The lighting apparatus may further include a first plurality of diodes electrically connected between the first LED array and the LED controller.

According to an aspect of yet another exemplary embodiment, there is provided a lighting apparatus including: a first plurality of LEDs, the first plurality of LEDs including a first LED and a second LED electrically connected to the first LED; a second plurality of LEDs, the second plurality of LEDs including a third LED and a fourth LED electrically connected to the third LED; a plurality of transistors, the plurality of transistors including a first transistor and a second transistor, wherein the first transistor is configured to electrically connect a power source to a first output terminal of the first LED and a third output terminal of the third LED, and the second transistor is configured to electrically connect the power source to a second output terminal of the second LED and a fourth output terminal of the fourth LED.

The lighting apparatus may further include a control circuit configured to generate a luminous flux control signal indicating a total current flowing through the first plurality of LEDs and the second plurality of LEDs.

The first transistor and the second transistor may be configured to turn on and turn off in accordance with the luminous flux control signal.

The first transistor may have a first turn-on voltage and the second transistor may have a second turn-on voltage.

The first turn-on voltage may be greater than the second turn-on voltage.

BRIEF DESCRIPTION OF DRAWINGS

The above and other aspects, features, and advantages will be more clearly understood from the following detailed description taken in conjunction with the accompanying drawings, in which.

DETAILED DESCRIPTION OF EXEMPLARY EMBODIMENTS

Figure 1:
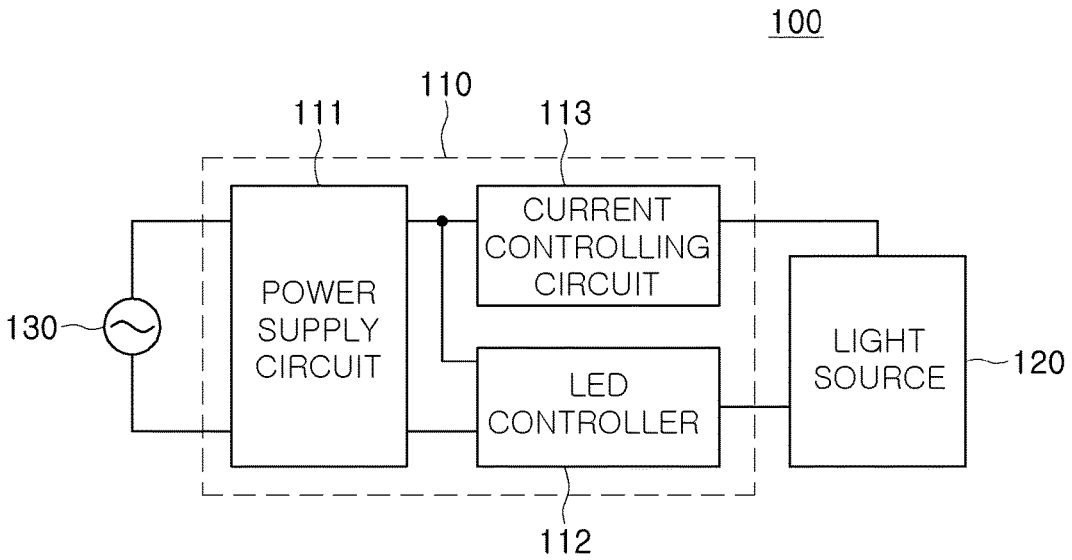
FIG. 1 is a block diagram of a lighting apparatus according to an exemplary embodiment.

Hereinafter, exemplary embodiments will be described as follows with reference to the attached drawings.

The present disclosure may, however, be exemplified in many different forms and should not be construed as being limited to the exemplary embodiments set forth herein. Rather, these exemplary embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other intervening elements may be present therebetween. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular exemplary embodiments only and is not intended to be limiting. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

Hereinafter, exemplary embodiments will be described with reference to schematic views illustrating exemplary embodiments of the present disclosure. In the drawings the illustrated shape may be estimated. Thus, exemplary embodiments should not be construed as being limited to the particular illustrated shapes.

FIG. 1 is a block diagram of a lighting apparatus according to an exemplary embodiment.

Referring to FIG. 1, a lighting apparatus 100 according to an exemplary embodiment may include a light emitting diode (LED) driving apparatus 110, a light source 120, and a power supply 130.

The power supply 130 may be a commercial power source supplying alternating current (AC) power and may output, for example, 60 Hz 220V AC power.

The light source 120 may include a plurality of LEDs connected to each other in series and/or in parallel. Here, the plurality of LEDs may be divided into a plurality of groups. According to an exemplary embodiment, the plurality of groups may be equally divided on the basis of a number of LEDs. In the case that all of LEDs included in a single group are connected to each other in series, the single group may form a single LED array. The light source 120 may include two or more groups, and thus, two or more LED arrays. Details thereof will be described below with reference to FIGS. 7 and 8.

The LED driving apparatus 110 may include a power supply circuit 111, an LED controller 112, and a current controlling circuit 113.

The power supply circuit 111 may include a rectifier circuit, such as a full-wave rectifier, to rectify AC power output by the power supply 130, a compensator circuit to compensate output of the rectifier circuit, and the like. According to an exemplary embodiment, the rectifier circuit may include a diode bridge circuit, and the compensator circuit may include a valley-fill circuit.

The LED controller 112 may control the at least two LED arrays included in the light source 120 by driving power output by the power supply circuit 111, and may be implemented as an IC chip. The LED controller 112 may include a plurality of internal switches, and each of the plurality of internal switches may be connected to output terminals of the plurality of LEDs included in the light source 120.

Here, the LED controller 112 may simultaneously control a current flowing through each of the at least two LED arrays. Details thereof will be described below with reference to FIGS. 5 and 6.

The current controlling circuit 113 may be provided separately from the LED controller 112, and may include circuit elements, such as at least one switch element, a resistor, and the like. While the current controlling circuit 113 operates, a current flowing through an LED array included in the light source 120 may be distributed to the LED controller 112 and the current controlling circuit 113, and a stress on the LED controller 112 may thus be reduced. Therefore, circuit damage due to current stress may be prevented, and heating occurring in the LED driving apparatus 110 may be reduced.

Here, the current controlling circuit 113 may control the magnitude of a current flowing through each of the plurality of groups of the plurality of LEDs. Details thereof will be described below with reference to FIGS. 3 and 4.

Figure 2:
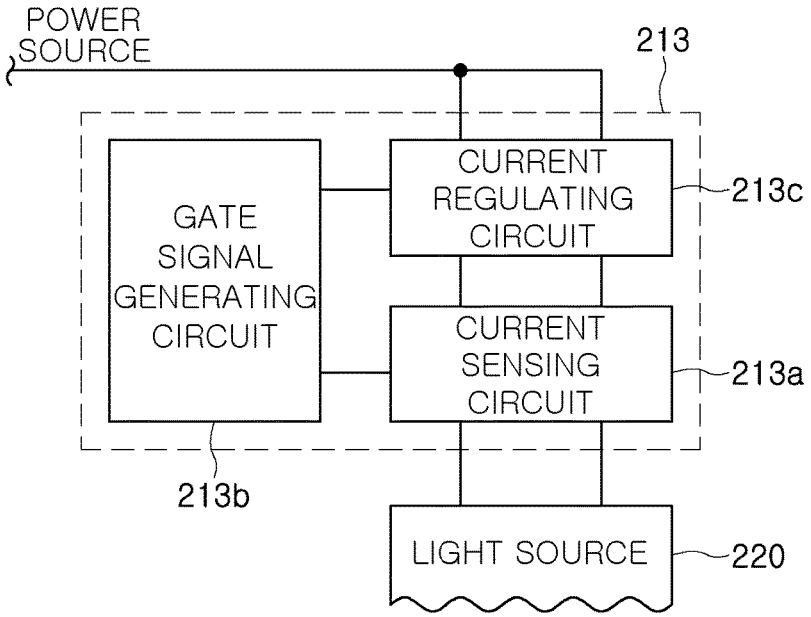
FIG. 2 is a block diagram of a current controlling circuit illustrated in FIG. 1.

FIG. 2 is a block diagram of the current controlling circuit illustrated in FIG. 1.

Referring to FIG. 2, a current controlling circuit 213 may include a current sensing circuit 213*a*, a control signal generating circuit 213*b*, and a current regulating circuit 213*c*.

The current sensing circuit 213*a* may sense a current flowing to a light source 220. According to an exemplary embodiment, the current sensing circuit 213*a* may sense a current flowing through each of at least two LED arrays.

The control signal generating circuit 213*b* may generate a control signal based on a current sensed by the current sensing circuit 213*a*. According to an exemplary embodiment, the control signal generating circuit 213*b* may generate a control signal having a voltage level lower than a common voltage level when the magnitude of a current flowing through a single LED array is higher than that of a predetermined current. According to an exemplary embodiment, the control signal generating circuit 213*b* may generate a control signal having a voltage level higher than a common voltage level when the magnitude of a current flowing through a single LED array is lower than that of a current flowing through another LED array.

The current regulating circuit 213*c* may receive a control signal and regulate a current flowing through each of the at least two LED arrays.

Figure 3:
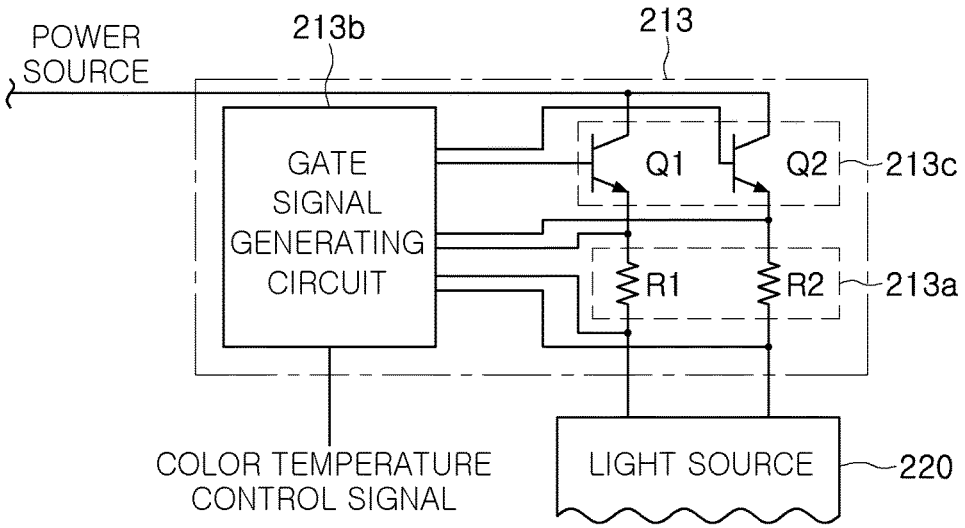
FIG. 3 is a circuit diagram of the current controlling circuit illustrated in FIG. 1.

FIG. 3 is a circuit diagram of the current controlling circuit illustrated in FIG. 1.

Referring to FIG. 3, the current controlling circuit 213 may include a plurality of resistors (R1 and R2), a plurality of transistors (Q1 and Q2), and the control signal generating circuit 213*b*.

Each of the plurality of resistors (R1 and R2) may be respectively connected to one of the at least two LED arrays, and may have a predetermined resistance value. A value obtained by dividing a voltage supplied to the plurality of resistors (R1 and R2) by the predetermined resistance value may correspond to a magnitude of a current flowing through the plurality of resistors (R1 and R2).

Each of the plurality of transistors (Q1 and Q2) may be respectively connected to one of the at least two LED arrays, and may receive a control signal through an input terminal and regulate a current flowing through a drain terminal and a source terminal. Here, the plurality of transistors (Q1 and Q2) may operate in saturation mode. When a voltage between the drain terminal and the source terminal is constant in the saturation mode, a current flowing through the drain terminal and the source terminal may be increased as a voltage level of the control terminal increases. Therefore, a voltage level of a signal input to the control terminal of the plurality of transistors (Q1 and Q2) may be adjusted, and thus, the magnitude of a current flowing through the plurality of transistors (Q1 and Q2) may be controlled.

Meanwhile, the plurality of transistors (Q1 and Q2) may be replaced by a variable resistor. When a voltage supplied to the variable resistor is constant, as a resistance value of the variable resistor increases, the magnitude of a current flowing through the variable resistor decreases. Therefore, the adjustment of a resistance value of the variable resistor may be used to control the magnitude of a current flowing through the variable resistor.

The control signal generating circuit 213*b* may receive a color temperature control signal and control color temperatures of light emitted by the light source 220. According to an exemplary embodiment, a color temperature control signal may be generated by a control circuit, which determines a color of light emitted by the external light source 220 of an LED driving apparatus, and applied to the control signal generating circuit 213*b*. A color temperature may be set as a value relative to an absolute temperature. According to an exemplary embodiment, because a color temperature of blue-based color is generally high, the color temperature of the blue-based color may be set as a high value. Details thereof will be described below with reference to FIG. 19.

In addition, the control signal generating circuit 213*b* may compare a current flowing through each of the plurality of resistors (R1 and R2) to a current corresponding to a color temperature control signal to determine a voltage level of a control signal. According to an exemplary embodiment, when color temperature control signals control the light source 220 to emit light having high color temperatures, the magnitude of a current corresponding to a first LED array may be high, and that of a current corresponding to a second LED array may be small, among currents corresponding to the color temperature control signals. Correspondingly, a level of a control voltage applied to the transistor Q1 connected to the first LED array may be increased, and a level of a control voltage applied to the transistor Q2 connected to the second LED array may be decreased.

According to an exemplary embodiment, the light source 220 may include a first LED array emitting light having a maximum color temperature, a second LED array emitting light having a minimum color temperature, and may further include a third LED array emitting light having an intermediate color temperature. The current controlling circuit 213 may control respective currents flowing through at least two of the LED arrays, thereby controlling color temperatures of the light source 220.

Figure 4:
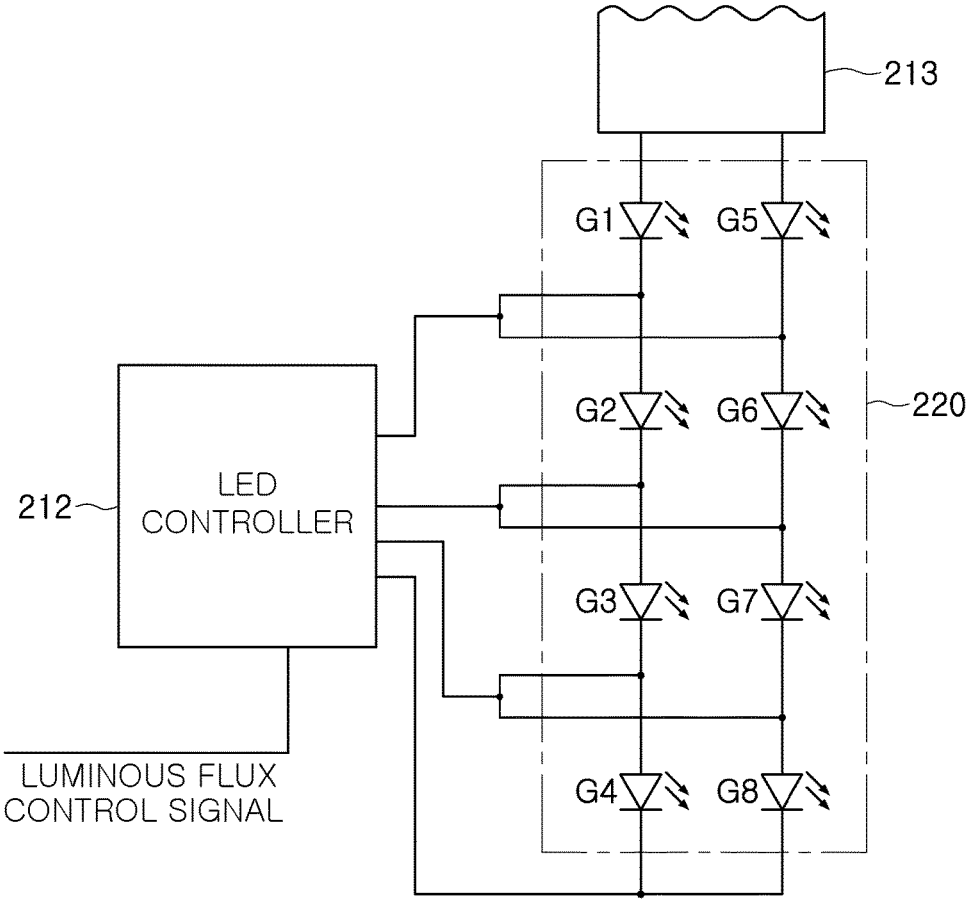
FIG. 4 is a block diagram of an LED controller illustrated in FIG. 1.

FIG. 4 is a block diagram of the LED controller illustrated in FIG. 1.

Referring to FIG. 4, the LED controller 212 may receive a luminous flux control signal and control on/off switching operations of each of the LEDs included in the light source 220. Here, the luminous flux control signal may be generated by a control circuit, which determines the luminous flux of the external light source 220 of an LED driving apparatus, and applied to the LED controller 212. According to an aspect of an exemplary embodiment, the control circuit may collectively generate a color temperature control signal and a luminous flux control signal, and apply the generated signals to the LED driving apparatus.

Luminous flux indicates an amount of light passing through a surface having a unit area for a unit time. Therefore, the luminous flux may be increased as the amount of a total amount of current flowing through the plurality of LEDs included in the light source 220 is increased. According to an exemplary embodiment, the LED controller 212 may control a current supplied to the light source 220 by controlling a voltage level of a luminous flux control signal proportional to the level of a total current flowing through the plurality of LEDs.

The LED controller 212 may control at least two LED arrays simultaneously. According to an exemplary embodiment, the LED controller 212 may control on/off switching operations of a first LED (G1) and a fifth LED (G5) simultaneously, may control on/off switching operations of a second LED (G2) and a sixth LED (G6) simultaneously, may control on/off switching operations of a third LED (G3) and a seventh LED (G7) simultaneously, and may control on/off switching operations of a fourth LED (G4) and an eighth LED (G8) simultaneously. Here, the first LED (G1), the second LED (G2), the third LED (G3), and the fourth LED (G4) may form the first LED array emitting light having one of the maximum color temperature, the intermediate color temperature, and the minimum color temperature. Here, the fifth LED (G5), the sixth LED (G6), the seventh LED (G7), and the eighth LED (G8) may form the second LED array emitting light having a color temperature different to the first LED array.

The LED controller 112 may control the at least two LED arrays simultaneously, and the on/off switching operations or luminous flux of the light source 220 may thus be controlled without substantially affecting the color temperature of the light source 220. Similarly, the current controlling circuit 213 may control the color temperature of the light source 220 without substantially affecting the luminous flux thereof. For example, the on/off switching operations and luminous flux of the light source 220 and the color temperature thereof may be controlled to be orthogonal to each other.

Figure 5:
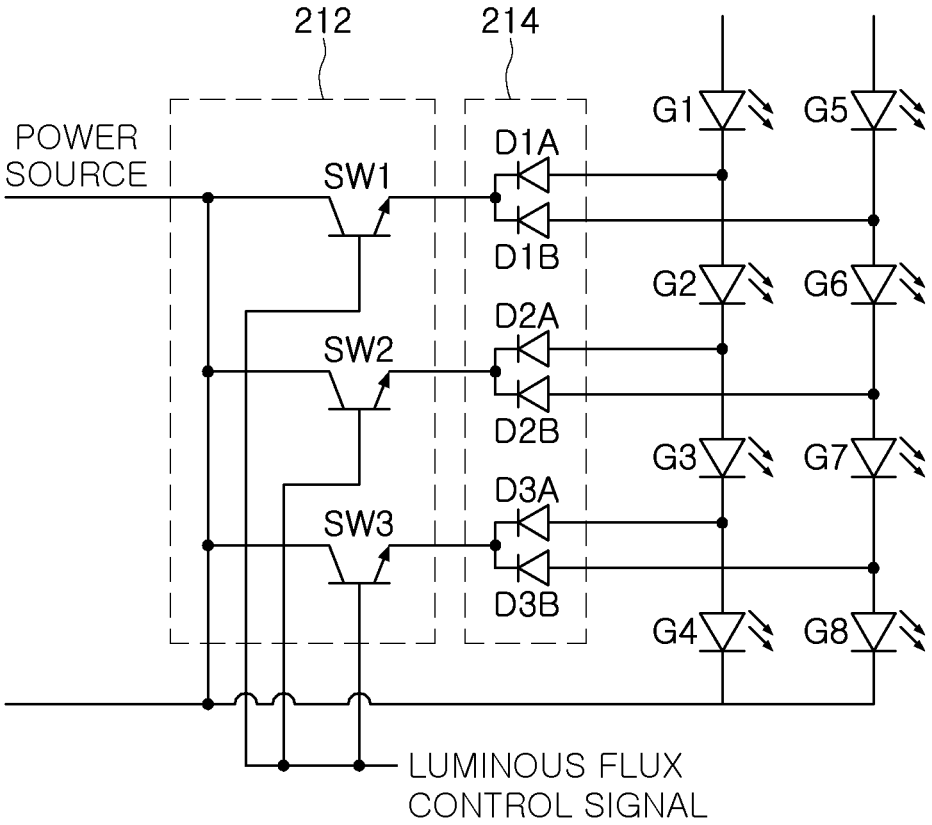
FIG. 5 is a circuit diagram of the LED controller illustrated in FIG. 1.

FIG. 5 is a circuit diagram of the LED controller illustrated in FIG. 1.

Referring to FIG. 5, the LED controller 212 may include first to third common control switches (SW1, SW2, and SW3) to simultaneously control on/off switching operations of each of the respective LEDs included in the light source 220.

According to an exemplary embodiment, a source or drain terminal of the first common control switch (SW1) may be connected to output terminals of the first LED (G1) and the fifth LED (G5), and an input terminal of the first common control switch (SW1) may receive a luminous flux control signal.

According to an exemplary embodiment, a source or drain terminal of the second common control switch (SW2) may be connected to output terminals of the second LED (G2) and the sixth LED (G6), and an input terminal of the second common control switch (SW2) may receive a luminous flux control signal.

According to an exemplary embodiment, a source or drain terminal of the third common control switch (SW3) may be connected to output terminals of the third LED (G3) and the seventh LED (G7), and an input terminal of the third common control switch (SW3) may receive a luminous flux control signal.

The number of common control switches being turned on among the first to third common control switches (SW1, SW2, and SW3) may be proportional to the number of LEDs being turned on among the plurality of LEDs included in the light source 220. Therefore, control of the first to third common control switches (SW1, SW2, and SW3) may allow the number of LEDs being turned on to be controlled.

According to an exemplary embodiment, minimum voltage levels at which each of the first to third common control switches (SW1, SW2, and SW3) may be turned on may be set as different values. For example, the source terminal of the first common control switch (SW1) may be set to turn on at a high voltage level, and the source terminal of the third common control switch (SW3) may be set to turn on at a low voltage level. Here, each of the first to third common control switches (SW1, SW2, and SW3) may be turned on or off according to a difference between a voltage level of a luminous flux control signal and a voltage level of the source terminal of each of the first to third common control switches (SW1, SW2, and SW3). Therefore, as a voltage level of a luminous control signal is increased, the first to third common control switches (SW1, SW2, and SW3) may be sequentially turned on. Meanwhile, a threshold voltage of each of the first to third common control switches (SW1, SW2, and SW3) may be set as a different value, and each of the first to third common control switches (SW1, SW2, and SW3) may thus be sequentially turned on.

Referring to FIG. 5, the LED controller 212 and the light source 220 (refer to FIGS. 2 through 4) may include a plurality of diodes 214 provided therebetween and connected between the at least two LED arrays and the LED controller 212, such that a current flowing through one of the at least two LED arrays may not flow to the remainder thereof.

According to an exemplary embodiment, a first diode (D1A) may be connected between the output terminal of the first LED (G1) and the first common control switch (SW1). A second diode (D2A) may be connected between the output terminal of the second LED (G2) and the second common control switch (SW2). A third diode (D3A) may be connected between the output terminal of the third LED (G3) and the third common control switch (SW3). A fourth diode (D1B) may be connected between the output terminal of the fifth LED (G5) and the first common control switch (SW1). A fifth diode (D2B) may be connected between the output terminal of the sixth LED (G6) and the second common control switch (SW2). A sixth diode (D3B) may be connected between the output terminal of the seventh LED (G7) and the third common control switch (SW3).

The plurality of diodes 214 may reduce interference between the at least two LED arrays. Therefore, the plurality of diodes 214 may reduce interference which may occur because the LED controller 212 controls the at least two LED arrays simultaneously.

Figure 6:
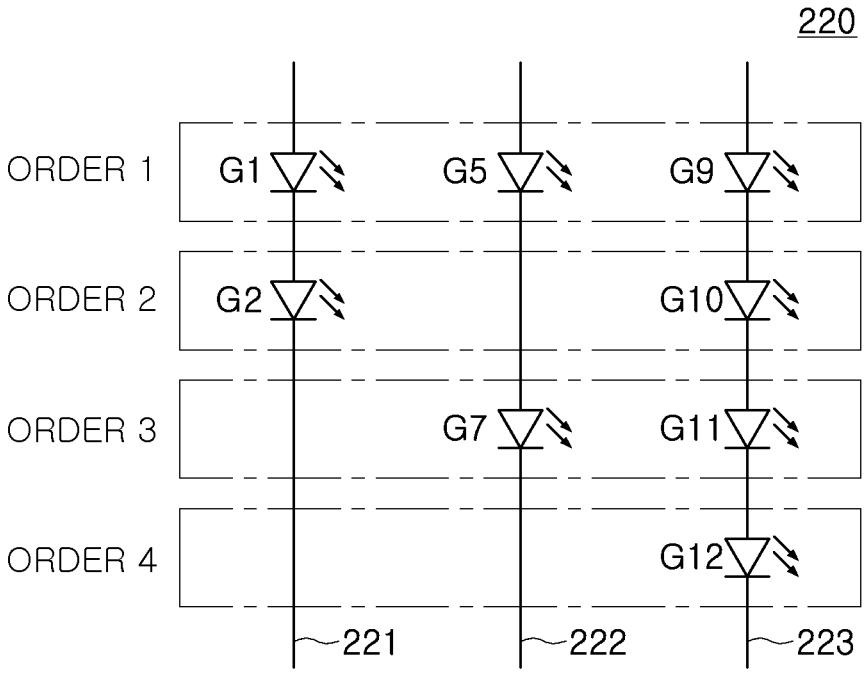
FIG. 6 is a block diagram of a light source illustrated in FIG. 1.

FIG. 6 is a block diagram of the light source illustrated in FIG. 1.

Referring to FIG. 6, the light source 220 may include a first LED array 221, a second LED array 222, and a third LED array 223. For convenience of description, the three LED arrays will be described through FIG. 6, but according to various exemplary embodiments, the light source 220 may include n LED arrays, where, n is a positive integer. For convenience of description, it may be described that up to four LEDs may be connected in each LED array, but each LED array may include up to k LEDs (where, k is a positive integer).

According to an exemplary embodiment, respective LEDs included in the first to third LED arrays 221, 222, and 223 may be given orders, respectively. For example, a first LED (G1) included in the first LED array 221, a fifth LED (G5) included in the second LED array 222, and a ninth LED (G9) included in the third LED array 223 may be given Order 1. For example, a second LED (G2) included in the first LED array 221 and a tenth LED (G10) included in the third LED array 223 may be given Order 2. For example, a seventh LED (G7) included in the second LED array 222 and an eleventh LED (G11) included in the third LED array 223 may be given Order 3. For example, a twelfth LED (G12) included in the third LED array 223 may be given Order 4.

Here, Order may refer to on/off sequences by luminous flux control of the LED controller 212. For example, when a voltage level of a luminous flux control signal is decreased by a single stage from a maximum voltage level, the first LED (G1), the fifth LED (G5), and the ninth LED (G9) corresponding to Order 1 may be turned off. For example, when a voltage level of a luminous flux control signal is decreased by two stages from the maximum voltage level, the second LED (G2) and the tenth LED (G10) corresponding to Order 2 may be turned off. For example, when a voltage level of a luminous flux control signal is decreased by three stages from the maximum voltage level, the seventh LED (G7) and the eleventh LED (G11) corresponding to Order 3 may be turned off. For example, when a voltage level of a luminous flux control signal is decreased by four stages from the maximum voltage level, the twelfth LED (G12) corresponding to Order 4 may be turned off.

Figure 7:
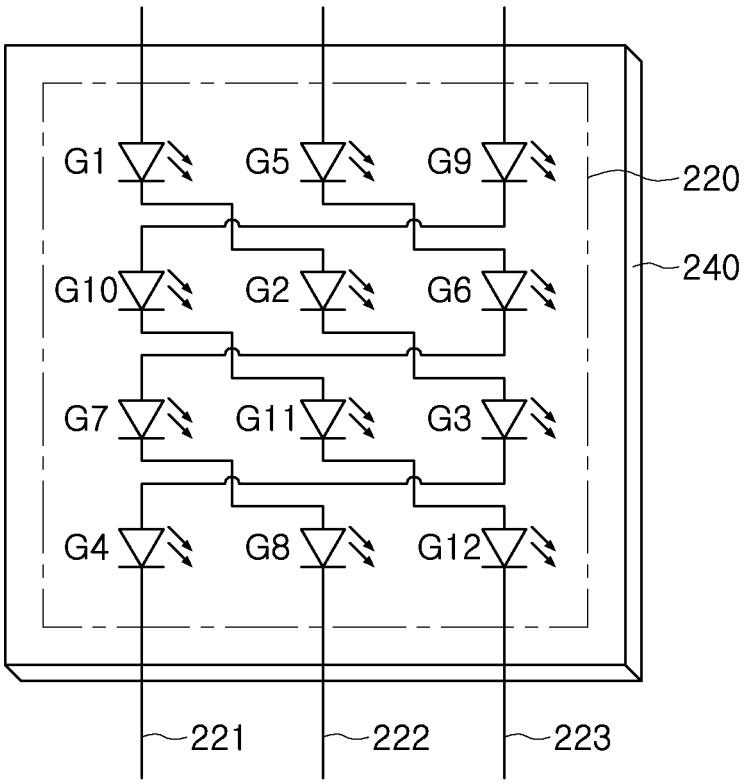
FIG. 7 is a circuit diagram of the light source illustrated in FIG. 1.

FIG. 7 is a circuit diagram of the light source illustrated in FIG. 1.

Referring to FIG. 7, a lighting apparatus according to an exemplary embodiment may further include a substrate 240 on which first to third LED arrays 221, 222, and 223 are mounted.

According to an exemplary embodiment, the first to third LED arrays 221, 222, and 223 may cross each other. For example, a first LED (G1) and a fourth LED (G4) included in the first LED array 221, a tenth LED (G10) included in the third LED array 223, and a seventh LED (G7) included in the second LED array 222 may be disposed in a left column. For example, a fifth LED (G5) and an eighth LED (G8) included in the second LED array 222, a second LED (G2) included in the first LED array 221, and an eleventh LED (G11) included in the third LED array 223 may be disposed in a center column. For example, a ninth LED (G9) and a twelfth LED (G12) included in the third LED array 223, a sixth LED (G6) included in the second LED array 222, and a third LED (G3) included in the first LED array 221 may be disposed in a right column.

Generally, light emitted by a plurality of LEDs included in a light source 220 may be diffused. According to an exemplary embodiment, because the first to third LED arrays 221, 222, and 223 divided on the basis of color temperatures in the light source 220 may cross each other, and the light emitted by the plurality of LEDs is scattered, the light source 220 may emit light having natural color temperatures.

Figure 8:
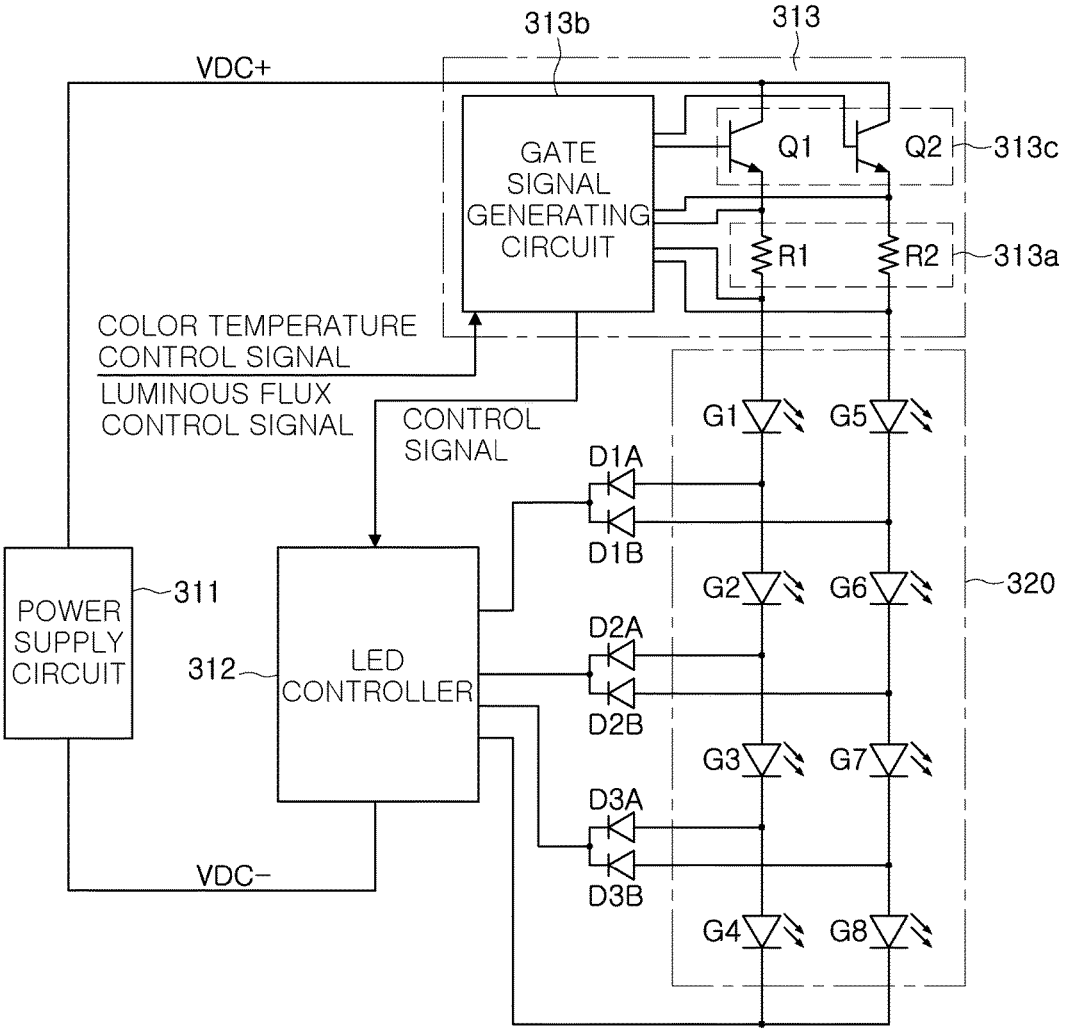
FIG. 8 is a circuit diagram of a light emitting diode (LED) driving apparatus according to an exemplary embodiment.

FIG. 8 is a circuit diagram of a light emitting diode (LED) driving apparatus according to an exemplary embodiment.

Referring to FIG. 8, power (VDC+ and VDC−) supplied by a power supply circuit 311 may be provided to an LED controller 312 and a current controlling circuit 313. The current controlling circuit 313 may sense a total current traveling through the current sensing circuit 313*a* including a plurality of resistors (R1 and R2), generate a control signal corresponding to the sensed total current through a control signal generating circuit 313*b*, and regulate current through a current regulating circuit 313*c* including a plurality of transistors (Q1 and Q2). The LED controller 312 may control a current for each of a plurality of LEDs included in a light source 320 (G1, G2, G3, G4, G5, G6, G7, and G8), and simultaneously control a current for the LEDs included in a first LED array (G1, G2, G3, and G4) and the LEDs included in a second LED array (G5, G6, G7, and G8). In addition, the LED controller 312 and the light source 320 may have a plurality of diodes (D1A, D1B, D2A, D2B, D3A, and D3B) connected therebetween.

The control signal generating circuit 313*b* may receive a color temperature control signal and a luminous flux control signal. The control signal generating circuit 313*b* may process one of the color temperature control signal and the luminous flux control signal to generate and output an IC control signal controlling the LED controller 312. For example, signals applied externally from an LED driving apparatus may be received through a single path. According to an exemplary embodiment, applied signals may be processed by a circuit specialized to process externally applied signals. Here, a portion of the processed signals may be applied to a circuit controlling each of the LEDs, such as the LED controller 312, and the remainder of the processed signals may be applied to a circuit controlling currents for the LED arrays, such as the current regulating circuit 313*c*.

Figure 9A:
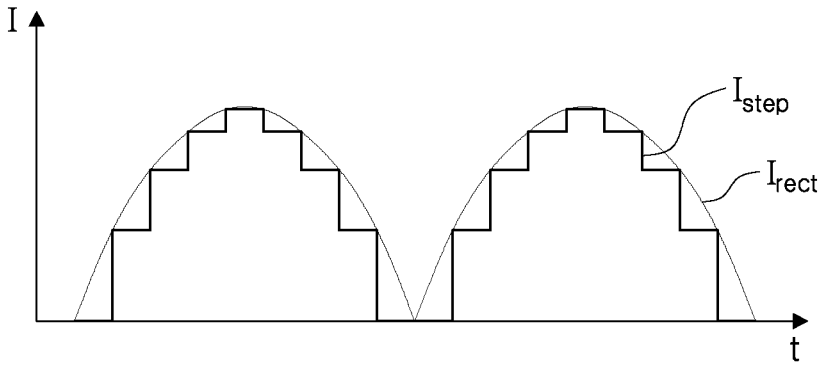
FIGS. 9A and 9B are graphs of a current and a power supply current flowing through a light source of a lighting apparatus according to an exemplary embodiment, respectively.
Figure 9B:
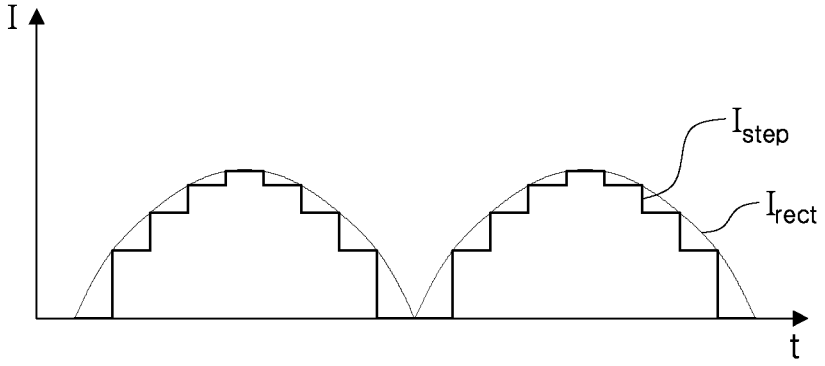

FIGS. 9A and 9B are graphs of a current and a power supply current flowing through a light source of a lighting apparatus according to an exemplary embodiment, respectively.

FIG. 9A illustrates a current ($I_{step}$) and a power supply current ($I_{rect}$) flowing through the light source when the light source is controlled to output light at a high luminous flux by a luminous flux control signal, and FIG. 9B illustrates a current ($I_{step}$) and a power supply current ($I_{rect}$) flowing through the light source when the light source is controlled to output light at a low luminous flux by a luminous flux control signal.

For example, a lighting apparatus according to an exemplary embodiment may determine the waveform of a current ($I_{step}$) flowing through a light source by sequentially controlling on/off switching operations of LEDs based on a power supply current ($I_{rect}$), and may determine a total magnitude of a current ($I_{step}$) flowing through the light source based on a luminous flux control signal.

FIGS. 10 through 13 are diagrams of semiconductor light emitting devices which may be implemented in a lighting apparatus according to various exemplary embodiments.

Figure 10:
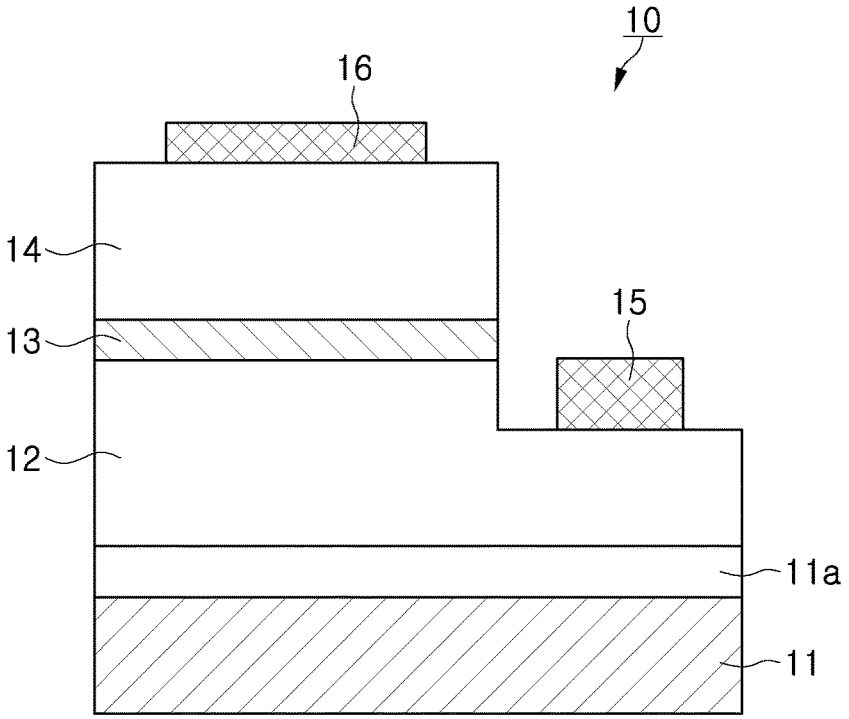
FIGS. 10 through 13 are diagrams of semiconductor light emitting devices which may be applied to a lighting apparatus according to an exemplary embodiment, respectively.

First, referring to FIG. 10, a semiconductor light emitting device 10 according to an exemplary embodiment may include a substrate 11, a first conductive semiconductor layer 12, an active layer 13, and a second conductive semiconductor layer 14. In addition, the first conductive semiconductor layer 12 may have a first electrode 15 formed thereon, and the second conductive semiconductor layer 14 may have a second electrode 16 formed thereon. The second electrode 16 and the second conductive semiconductor layer 14 may further have an ohmic contact layer selectively provided therebetween.

First, at least one of an insulating substrate, a conductive substrate, or a semiconductor substrate may be implemented as the substrate 11 according to various exemplary embodiments. The substrate 11 may be, for example, sapphire, SiC, Si, $MgAl_2O_4$, MgO, $LiAlO_2$, $LiGaO_2$, GaN. For epitaxial growth of a GaN material, a GaN substrate, a same kind of substrate, may be selected as the substrate 11, and a sapphire substrate or a silicon carbide (SiC) substrate may be mainly used as a different kind of substrate. When a different kind of substrate is used, a difference between lattice constants of a substrate material and a thin film material may cause a defect, such as dislocation, to be increased, and a difference between thermal expansion coefficients of the substrate material and the thin film material may result in warping of the different substrate material when a temperature changes, and the warping may thus lead to cracking of a thin film. In order to address the above issues, the substrate 11, and the first conductive semiconductor layer 12 based on GaN may have a buffer layer 11*a* disposed therebetween.

When the first conductive semiconductor layer 12 containing GaN on a different kind of substrate is grown, a mismatch between lattice constants of a substrate material and a thin film material may cause dislocation density to be increased, and a difference between thermal expansion coefficients of the substrate material and the thin film material may lead to cracking and warping. In order to address the above issues, the substrate 11 and the first conductive semiconductor layer 12 may have the buffer layer 11*a* disposed therebetween. The buffer layer 11*a* may adjust the extent of warping of the substrate 11 when the active layer 13 is grown to reduce wavelength distribution of a wafer.

The buffer layer 11*a* may be formed using a composition of $Al_xIn_yGa_{1-x-y}N$ ($0 \le x \le 1$, $0 \le y \le 1$), in particular, GaN, AlN, AlGaN, InGaN, or InGaNAlN, and if necessary, even using a material, such as $ZrB_2$, $HfB_2$, ZrN, HfN, or TiN. The buffer layer 12 may also be formed by combining a plurality of layers or gradually changing the composition.

Because there is a large difference between thermal expansion coefficients of a silicon (Si) substrate and GaN, when a GaN-based thin film is grown at high temperatures and is then cooled at room temperature, a difference between thermal expansion coefficients of the Si substrate and the GaN-based thin film may cause tensile stress to act on the GaN-based thin film, and cracks may easily occur. Use of a method of growing a thin film such that compression stress may be applied to the thin film during the growth thereof as a method of preventing cracking, may allow tensile stress to be compensated. In addition, a difference between lattice constants of silicon (Si) and GaN may be more likely to cause a defect. Because stress control to suppress warping, as well as defect control in the case of using an Si substrate are required to be simultaneously performed, a buffer layer 11*a* having a complex structure may be used.

In order to form the buffer layer 11*a*, an AlN layer may be formed first on the substrate 11. A material not containing Ga may be used, and a material including SiC as well as AlN may also be used, in order to prevent a reaction occurring between Si and Ga. The AlN layer may be grown at a temperature between 400° C. and 1300° C. using an Al source and an N source, and if necessary, AlGaN interlayers to control stress on GaN may be inserted between a plurality of AlN layers.

The first and second conductive semiconductor layers 12 and 14 may include semiconductors doped with n- and p-type impurities, respectively. The first and second conductive semiconductor layers 12 and 14 are not limited thereto, but may be provided as p- and n-type semiconductor layers, respectively. For example, the first and second conductive semiconductor layers 12 and 14 may include, a group III nitride semiconductor, for example, a material having a composition of $Al_xIn_yGa_{1-x-y}N$ ($0 \le x \le 1$, $0 \le y \le 1$, $0 \le x+y \le 1$). The first and second conductive semiconductor layers 12 and 14 are not limited thereto, but may also be formed using a material, such as an AlGaInP-based semiconductor or an AlGaAs-based semiconductor.

Meanwhile, the first and second conductive semiconductor layers 12 and 14 may include a monolayer structure, but may conversely have a multilayer structure having different compositions or thicknesses. For example, the first and second conductive semiconductor layers 12 and 14 may have carrier injection layers improving injection efficiency of electrons and holes, respectively, and may also have various types of superlattice structures.

The first conductive semiconductor layer 12 may further include a current diffusion layer in a portion of the first conductive semiconductor layer 12 adjacent to the active layer 13. The current diffusion layer may have a structure, in which a plurality of $In_xAl_yGa_{1-x-y}N$ layers having different compositions or different impurity contents are repeatedly stacked, or may have an insulating material layer formed partially in the current diffusion layer.

The second conductive semiconductor layer 14 may further include an electron blocking layer in a portion of the second conductive semiconductor layer 14 adjacent to the active layer 13. The electron blocking layer may have a plurality of different compositions, $In_xAl_yGa_{1-x-y}N$, stacked, or at least one layer including a composition of $Al_yGa_{1-y}N$, and may prevent electrons from going to the second conductive semiconductor layer 14 due to a band gap higher than that of the active layer 13.

According to an exemplary embodiment, the first and second conductive semiconductor layers 12 and 14 and the active layer 13 may be produced by using a metal organic chemical vapour deposition (MOCVD) apparatus. In order to produce the first and second conductive semiconductor layers 12 and 14 and the active layer 13, organic metal compound gas (for example, trimethyl gallium (TMG), trimethyl aluminum (TMA), and the like) and nitrogen-containing gas (ammonia (NH3) or the like) may be supplied as reaction gases to a reaction vessel in which the substrate 11 is installed. The substrate 11 may remain heated at a high temperature in a range of 900° C. to 1100° C. Impurity gas may be supplied while a nitride gallium-based compound semiconductor is grown on the substrate 11. Thus, the nitride gallium-based compound semiconductor may be stacked as an undoped type, an n-type, or a p-type. Si is an n-type impurity, and Zn, Cd, Be, Mg, Ca, Ba, and the like are provided as p-type impurities, and Mg and Zn may be mainly used as p-type impurities.

In addition, the active layer 13 disposed between the first and second conductive semiconductor layers 12 and 14 may have a multiple quantum well (MQW) structure, in which quantum well layers and quantum barrier layers are alternately stacked on each other. For example, in the case that the active layer is a nitride semiconductor, the active layer 13 may have a GaN/InGaN structure, and may also have a single quantum well (SQW) structure. The first or second electrode 15 and 16 may contain a material, such as Ag, Ni, Al, Rh, Pd, Ir, Ru, Mg, Zn, Pt, or Au. The semiconductor light emitting device 10 may have an epi-up structure, and may thus be connected to a circuit pattern included in a circuit board in a light emitting device package by a wire or the like.

Figure 11:
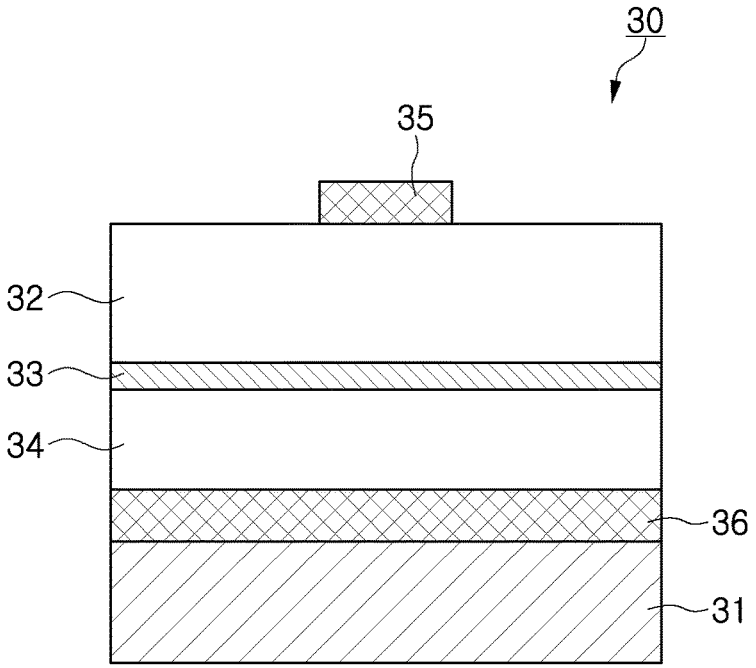

Next, FIG. 11, a semiconductor light emitting device according to an exemplary embodiment is illustrated. The semiconductor light emitting device 30 according to the exemplary embodiment illustrated in FIG. 11 may include a first conductive semiconductor layer 32, an active layer 33, a second conductive semiconductor layer 34, a first electrode 35 attached to the first conductive semiconductor layer 32, a second electrode 36 attached to the second conductive semiconductor layer 34, and the like. The second electrode 36 may have a conductive substrate 31 disposed on a lower surface thereof, and the conductive substrate 31 may be directly mounted on a circuit board or the like, configuring a light emitting device package. In the light emitting device package, the conductive substrate 31 may be directly mounted on the circuit board, and the first electrode 35 may be electrically connected to a circuit pattern included on the circuit board by a wire or the like.

Similar to the semiconductor light emitting devices 10 and 20 described above, the first conductive semiconductor layer 32 and the second conductive semiconductor layer 34 may contain an n-type nitride semiconductor and a p-type nitride semiconductor, respectively. Meanwhile, the active layer 33 disposed between the first and second conductive semiconductor layers 32 and 34 may have a multiple quantum well (MQW) structure, in which nitride semiconductor layers having different compositions are alternately stacked, and may have selectively a single quantum well (SQW) structure.

The first electrode 35 may be disposed on an upper surface of the first conductive semiconductor layer 32, and the second electrode 36 may be disposed on a lower surface of the second conductive semiconductor layer 34. The active layer 33 of the semiconductor light emitting device 30 illustrated in FIG. 11 may allow light generated by a recombination of electrons and holes to be emitted from the upper surface of the first conductive semiconductor layer 32 on which the first electrode 35 is disposed. Therefore, in order for light generated by the active layer 33 to be reflected toward the upper surface of the first conductive semiconductor layer 32, the second electrode 36 may be formed of a material having high reflectivity. The second electrode 36 may contain at least one of Ag, Al, Ni, Cr, Cu, Au, Pd, Pt, Sn, Ti, W, Rh, Ir, Ru, Mg, and Zn, or an alloy material including the same.

Figure 12:
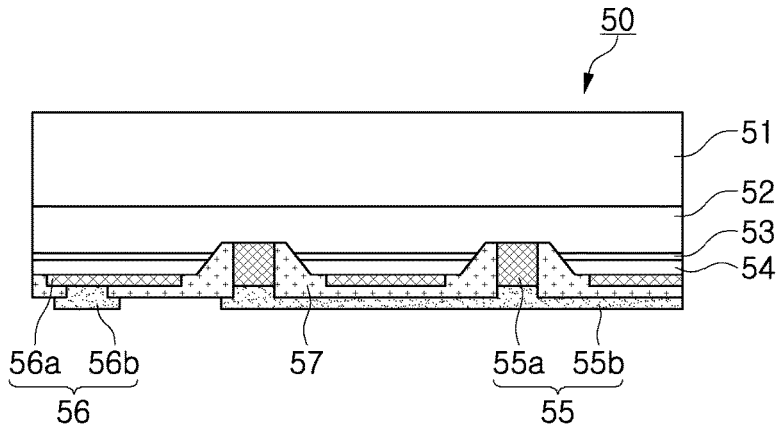

Next, referring to FIG. 12, a semiconductor light emitting device 50 according to an exemplary embodiment is illustrated. The semiconductor light emitting device 50 may include a first conductive semiconductor layer 52, an active layer 53, a second conductive semiconductor layer 54, a first electrode 55, and a second electrode 56, sequentially stacked on a surface of a substrate 51. The semiconductor light emitting device 50 may also include insulators 57. The first and second electrodes 55 and 56 may include first and second contact electrodes 55*a* and 56*a* and first and second connecting electrodes 55*b* and 56*b*, respectively, and portions of the contact electrodes 55*a* and 56*a* exposed by the insulators 57 may be connected to the connecting electrodes 55*b* and 56*b*, respectively.

The first contact electrode 55*a* may be provided as a conductive via passing through the second conductive semiconductor layer 54 and the active layer 53 to be connected to the first conductive semiconductor layer 52. The second contact electrode 56*a* may be connected to the second conductive semiconductor layer 54. A plurality of conductive vias may be formed in a single light emitting device region.

The first and second contact electrodes 55*a* and 56*a* may be formed by depositing a conductive ohmic material on the first and second conductive semiconductor layers 52 and 54. The first and second contact electrodes 55*a* and 56*a* may contain at least one of Ag, Al, Ni, Cr, Cu, Au, Pd, Pt, Sn, Ti, W, Rh, Ir, Ru, Mg, and Zn, or an alloy material including the same. In addition, the second contact electrode 56*a* may function to reflect light generated by the active layer 53 to be emitted below the semiconductor light emitting device 50.

The insulators 57 may have open regions exposing portions of the first and second contact electrodes 55*a* and 56*a*, and the first and second connecting electrodes 55*b* and 56*b* may be connected to the first and second contact electrodes 55*a* and 56*a*, respectively. The insulators 57 may be deposited to have a thickness in a range of 0.01 μm to 3 μm at a temperature less than 500° C. through an $SiO_2$ and/or SiN chemical vapor deposition (CVD) process. The first and second electrodes 55 and 56 may be mounted in a light emitting device package in the form of a flip chip.

The first and second electrodes 55 and 56 may be electrically isolated from each other by the insulators 57. The insulators 57 may be formed using any material having electrically insulating characteristics, and may have low light absorption in order to prevent light extraction efficiency of the semiconductor light emitting device 50 from deteriorating. For example, a silicon oxide, such as $SiO_2$, and a silicon nitride, such as $SiO_xN_y$ or $Si_xN_y$ may be used. If necessary, a light-reflective structure may be formed by dispersing a light-reflective filler in a light transmitting material.

The light transmitting substrate 51 may have a first surface and a second surface opposing the first surface, and at least one of the first and second surfaces may have an uneven structure formed thereon. An uneven structure that may be formed on a surface of the substrate 51 may be constructed by etching a portion of the substrate 51, and may include the same material as the substrate 51, or a heterogeneous material different from the substrate 51. For example, formation of an uneven structure at an interface between the substrate 51 and the first conductive semiconductor layer 52 may cause a path of light emitted by the active layer 53 to vary. Thus, a rate at which light is absorbed by a semiconductor layer may be reduced, and a light scattering ratio may be increased, resulting in improved light extraction efficiency. The substrate 51 and the first conductive semiconductor layer 52 may also have a buffer layer provided therebetween.

Figure 13:
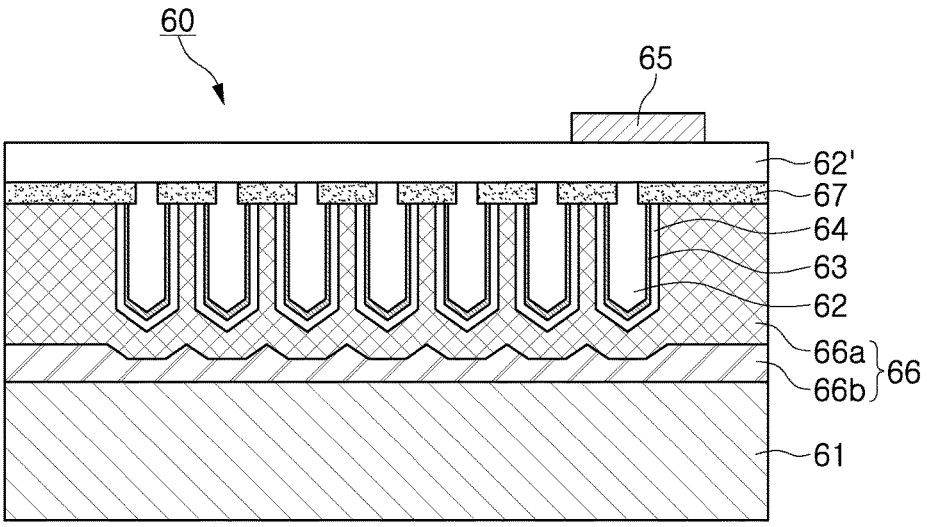

Next, referring to FIG. 13, a semiconductor light emitting device 60 according to an exemplary embodiment may have a nano-light emitting structure. The semiconductor light emitting device 60 may include a base layer 62' containing a first conductive semiconductor material, a mask layer 67 provided on the base layer 62' and having a plurality of openings, and nanocores 62 formed in the openings of the mask layer 67, respectively. Each of the nanocores 62 may have an active layer 63 and a second conductive semiconductor layer 64 provided thereon. The nanocores 62, the active layer 63, and the second conductive semiconductor layer 64 may form the nano-light emitting structure.

The second conductive semiconductor layer 64 may have a second contact electrode 66*a* provided thereon, and the second contact electrode 66*a* may have a second connecting electrode 66*b* provided on a surface thereof. The second contact electrode 66*a* and the second connecting electrode 66*b* may be provided as a second electrode 66. The second electrode 66 may have a support substrate 61 attached to a surface thereof, and the support substrate 61 may be a conductive substrate or an insulating substrate. When the support substrate 61 is conductive, the support substrate 61 may be directly mounted on a circuit board of a light emitting device package. The base layer 62' containing the first conductive semiconductor material may have a first electrode 65 provided thereon. The first electrode 65 may be connected to a circuit pattern included on the circuit board of the light emitting device package by a wire or the like.

Figure 14A:
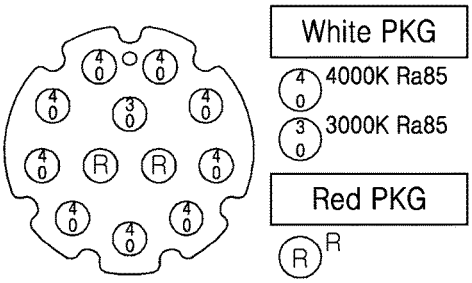
FIGS. 14A and 14B are simple diagrams of white light source modules which may be applied to a lighting apparatus according to an exemplary embodiment, respectively.
Figure 14B:
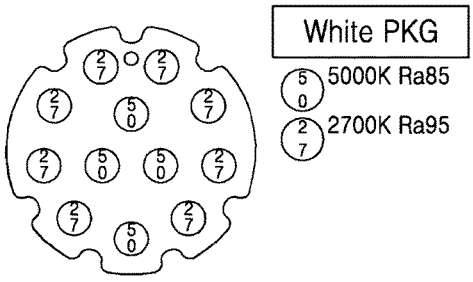
Figure 15:
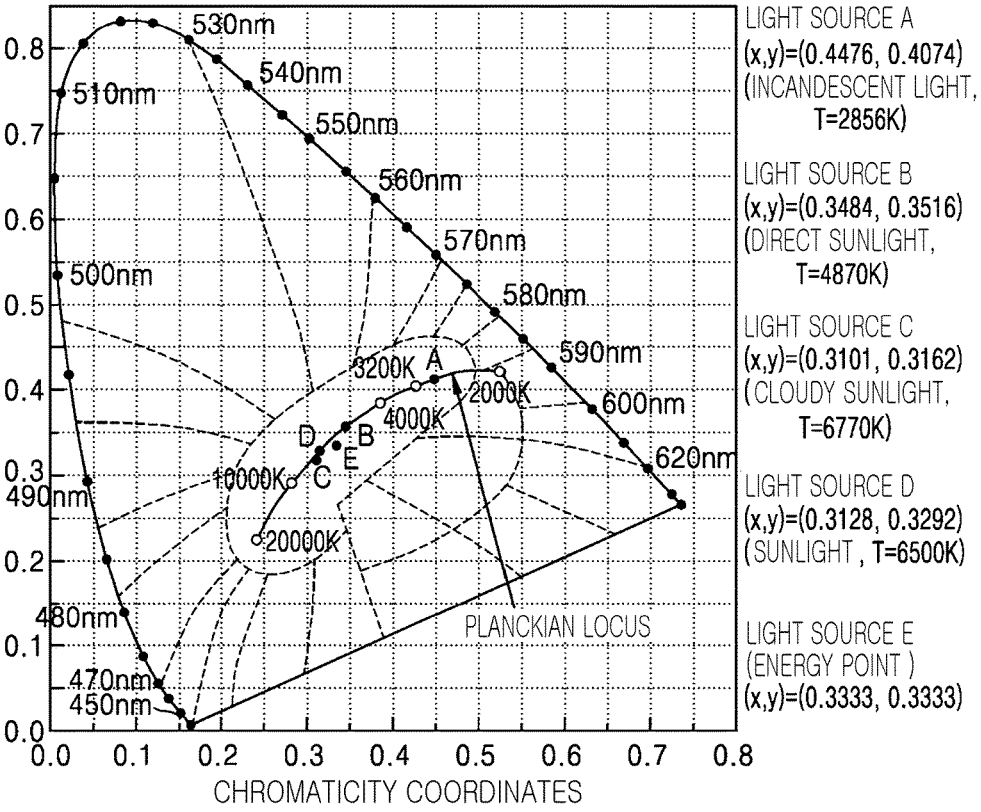
FIG. 15 is a CIE 1931 color space chromaticity diagram illustrating operations of the white light source modules respectively illustrated FIGS. 14A and 14B.

FIGS. 14A and 14B are simple diagrams of white light source modules which may be applied to a lighting apparatus according to an exemplary embodiment, respectively. FIG. 15 is a CIE 1931 color space chromaticity diagram illustrating operations of the white light source modules respectively illustrated FIGS. 14A and 14B.

The white light source modules respectively illustrated in FIGS. 14A and 14B may include a plurality of light emitting device packages mounted on respective circuit boards. A plurality of light emitting device packages mounted in a single white light source module may be configured of a same kind of package generating light having an identical wavelength, but as in the present exemplary embodiment, may also be formed of a different kind of package generating light having different wavelengths.

Referring to FIG. 14A, the white light source module may include a combination of white light emitting device packages 30 and 40 having color temperatures 3,000K and 4,000K, respectively, and red light emitting device packages RED (R). The white light source module may emit white light having a color temperature in a range of 3,300K to 4,000K, and a color rendering index (Ra) in a range of 95 to 100.

According to another exemplary embodiment, a white light source module may include only white light emitting device packages, and a portion thereof may emit white light having different color temperatures. For example, as illustrated in FIG. 14B, a white light source module may include a combination of white light emitting device packages 27 having a color temperature of 2,400K and white light emitting device packages having a color temperature of 5,000K may emit white light having a color temperature in a range of 2,400K to 5,000K and a color rendering index (Ra) in a range of 85 to 99. Here, the number of light emitting device packages having respective color temperatures may vary according to default color temperature settings. For example, if a lighting apparatus has a default color temperature setting adjacent to a color temperature of 4,000K, the lighting apparatus may include more light emitting device packages having a color temperature of 4,000K than light emitting device packages having a color temperature of 3,300K or red light emitting device packages.

As such, a different kind of light emitting device package may include at least one of a light emitting device, in which a blue light emitting device is combined with a yellow, green, red or orange phosphor to emit white light, and a purple, blue, green, red or infrared light emitting device, thereby adjusting a color temperature and a color rendering index (CRI) of white light. The above-mentioned white light source modules may be employed as light sources included in various types of lighting apparatuses.

A single light emitting device package may determine a required color of light according to wavelengths of a light emitting diode (LED) chip, that is, a light emitting device, and to types and mixing ratios of phosphors, and when a determined color of light is white, may adjust a color temperature and a color rendering index of the white light.

For example, when the LED chip emits blue light, the single light emitting device package including at least one of yellow, green, and red phosphors may emit white light having a variety of color temperatures according to mixing ratios of the yellow, green, and red phosphors. Conversely, a single light emitting device package in which a green or red phosphor is applied to a blue LED chip may emit green or red light. As such, a combination of the light emitting device package emitting white light and the light emitting device package emitting green or red light may allow a color temperature and a color rendering index of white light to be adjusted. In addition, a single light emitting device package may include at least one light emitting device emitting purple, blue, green, red or infrared light.

In this case, a lighting apparatus may adjust a color rendering index of a sodium (Na) lamp or the like to the level of sunlight, may also emit white light having various color temperatures in a range of 1,500K to 20,000K. If necessary, the lighting apparatus may emit purple, blue, green, red, and orange visible light or infrared light to adjust a lighting color according to the lighting apparatus' surroundings, or to set a desired mood. The lighting apparatus may also emit light having a certain wavelength that is able to promote plant growth.

White light generated by combining a blue light emitting device with yellow, green, and red phosphors and/or green and red light emitting devices may have at least two peak wavelengths, and as illustrated in FIG. 15, (x, y) coordinates of the CIE 1931 color space chromaticity diagram may be located in an area of segments connecting coordinates: (0.4476, 0.4074), (0.3484, 0.3516), (0.3101, 0.3162), (0.3128, 0.3292), and (0.3333, 0.3333). Alternatively, (x, y) coordinates may be located in an area surrounded by the segments and a blackbody radiation spectrum. A color temperature of the white light may range from 1,500K to 20,000K. As illustrated in FIG. 15, white light adjacent to Point E (0.3333, 0.3333) below the blackbody radiation spectrum may be used as a light source for lighting to create clearer viewing conditions for the naked eye in a state in which light having a yellow-based component is reduced. Thus, a lighting product using white light adjacent to Point E (0.3333, 0.3333) below the blackbody radiation spectrum may be useful as lighting for a retail space in which consumer goods are sold.

Figure 16:
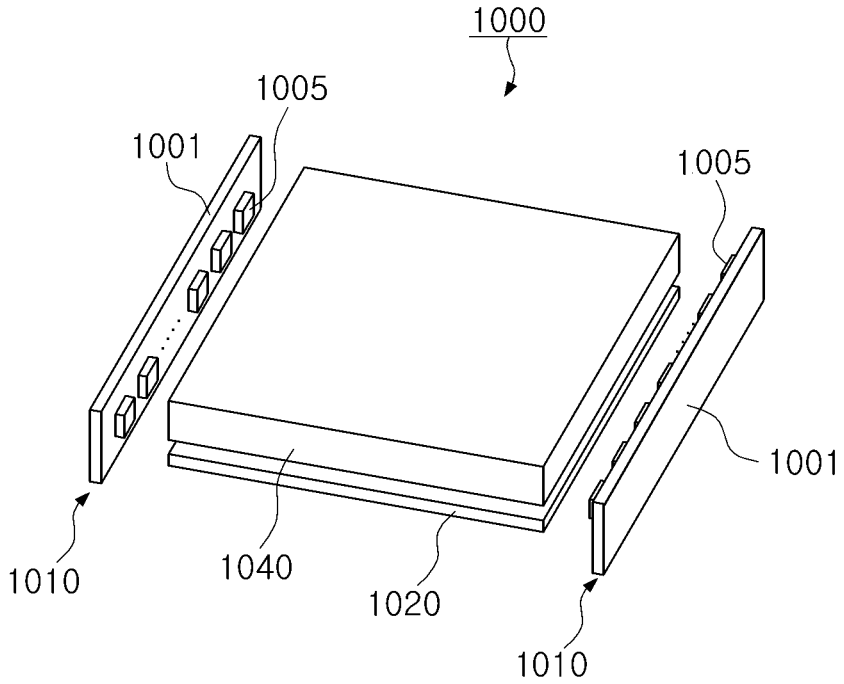
FIGS. 16 and 17 are diagrams of backlight units including an LED driving apparatus according to an exemplary embodiment, respectively.
Figure 17:
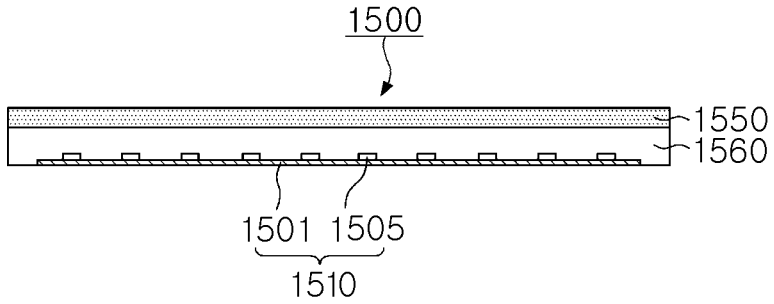

FIGS. 16 and 17 are diagrams of backlight units including an LED driving apparatus according to various exemplary embodiments.

Referring to FIG. 16, a backlight unit 1000 may include a light guide plate 1040, and light source modules 1010 provided on opposing side surfaces thereof, respectively. The backlight unit 1000 may also further include a reflective plate 1020 disposed below the light guide plate 1040. As illustrated in FIG. 16, the backlight unit 1000 may be an edge-type backlight.

According to an exemplary embodiment, the light source modules 1010 may only be provided on a side surface of the light guide plate 1040, or additionally on another side surface thereof. Each of the light source modules 1010 may include a printed circuit board (PCB) 1001 and a plurality of light sources 1005 disposed on an upper surface of the PCB 1001. The plurality of light sources 1005 may be driven by the LED driving apparatus 110 as described above with reference to FIG. 1.

A backlight unit 1500 of FIG. 17 may have a wavelength converter 1550, which is disposed in the backlight unit 1500 outside of the light sources 1505 to convert the wavelength of light.

Referring to FIG. 17, the backlight unit 1500 may be a direct-type backlight unit and may include the wavelength converter 1550, a light source module 1510 arranged below the wavelength converter 1550, and a bottom case 1560 accommodating the light source module 1510. The light source module 1510 may also include a PCB 1501 and the plurality of light sources 1505 mounted on an upper surface of the PCB 1501.

The backlight unit 1500 according to the present exemplary embodiment may have the wavelength converter 1550 disposed on an upper portion of the bottom case 1560. Therefore, the wavelength of at least a portion of light emitted by the light source module 1510 may be converted by the wavelength converter 1550. The wavelength converter 1550 may be manufactured as a separate film and applied, and may be integrated with a light diffusion plate.

The wavelength converter 1550 of FIG. 17 may contain a normal phosphor. In particular, when a quantum dot phosphor is used to complement the properties of a quantum dot vulnerable to heat or moisture from a light source, the structure of the wavelength converter 1550 illustrated in FIG. 17 may be utilized for the backlight unit 1500.

Figure 18:
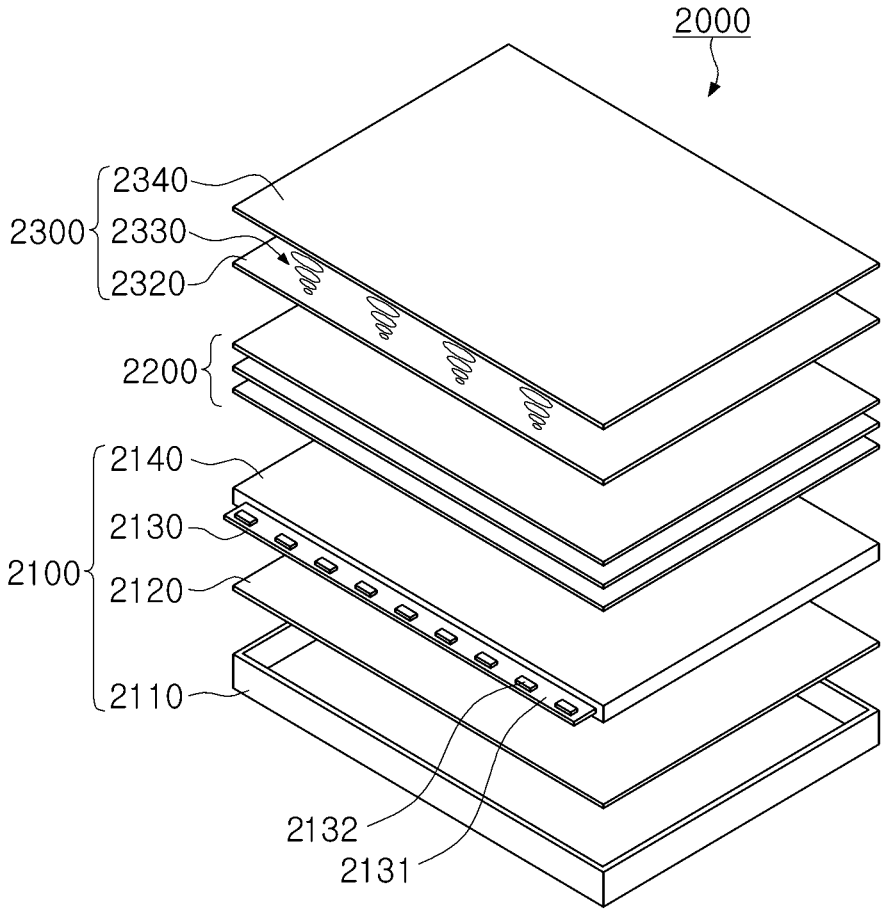
FIG. 18 is a schematic exploded perspective view of a display device in which a backlight unit including an LED driving apparatus is employed according to an exemplary embodiment.

FIG. 18 is a schematic exploded perspective view of a display device including a light emitting device package according to an exemplary embodiment.

Referring to FIG. 18, a display device 2000 may include a backlight unit 2100, optical sheets 2200, and an image display panel 2300 such as a liquid crystal panel.

The backlight unit 2100 may include a bottom case 2110, a reflector 2120, a light guide plate 2140, and a light source module 2130 provided on at least one side surface of the light guide plate 2140. The light source module 2130 may include a PCB 2131 and a plurality of light sources 2132. In particular, the light sources 2105 may be driven by the LED driving apparatus 110 as described above with reference to FIG. 1.

The optical sheets 2200 may be disposed between the light guide plate 2140 and the image display panel 2300, and may include various types of sheets, such as a diffusion sheet, a prism sheet and a protection sheet.

The image display panel 2300 may display an image using light emitted through the optical sheets 2200. The image display panel 2300 may include an array substrate 2320, a liquid crystal layer 2330, and a color filter substrate 2340. The array substrate 2320 may include pixel electrodes disposed in a matrix, thin film transistors applying a driving voltage to the pixel electrodes, and signal lines operating the thin film transistors. The color filter substrate 2340 may include a transparent substrate, a color filter, and a common electrode. The color filter may include filters selectively passing light having a certain wavelength of white light emitted by the backlight unit 2100. The liquid crystal layer 2330 may be re-arranged by an electrical field generated between the pixel electrodes and the common electrode to adjust light transmittance. Light with an adjusted level of light transmittance may be projected to display an image by passing the color filter of the color filter substrate 2340. The image display panel 2300 may further include a driving circuit unit to process an image signal.

The display device 2000 according to the present exemplary embodiment may allow the light sources 2132 to emit blue, green, and red light having a relatively narrow full width at half maximum such that the emitted light may pass through the color filter substrate 2340, thereby implementing blue, green, and red light having high color purity.

Figure 19:
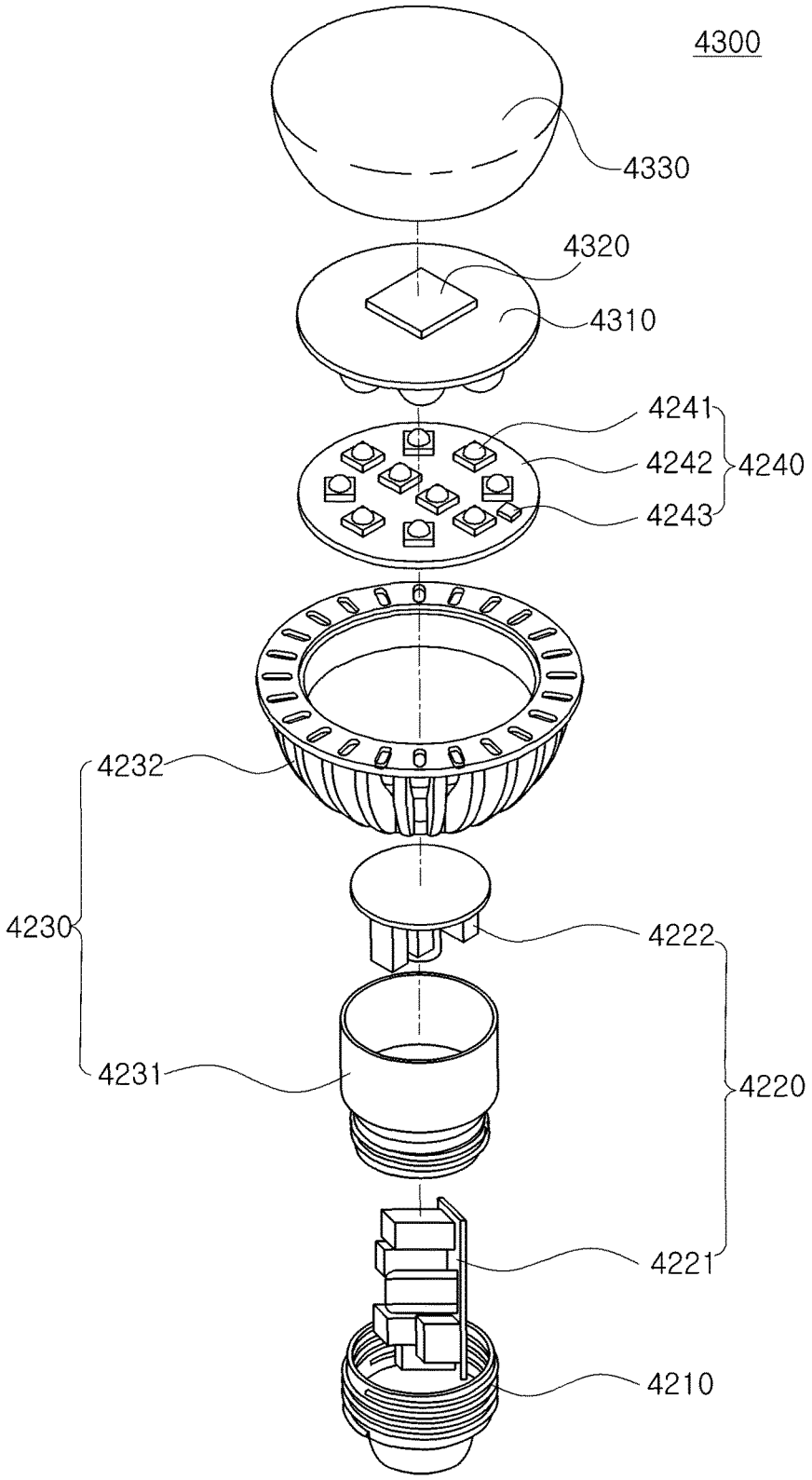
FIG. 19 is a diagram of a lighting apparatus according to an exemplary embodiment.

FIG. 19 is a schematic exploded perspective view of a lamp including a communications module as a lighting apparatus according to an exemplary embodiment.

In more detail, a lighting apparatus 4300 according to the present exemplary embodiment may include a reflector 4310 disposed above a light source module 4240. The reflector 4310 may reduce glare by evenly spreading light emitted by light sources to a side and a rear of the reflector 4310.

A communications module 4320 may be mounted on an upper portion of the reflector 4310, and may perform home network communications. For example, the communications module 4320 may a wireless communications module using Zigbee™, wireless fidelity (Wi-Fi), or light fidelity (Li-Fi), and may control on/off switching operations and brightness of a lighting apparatus installed in and around the home through a smartphone or a wireless controller. Further, use of a Li-Fi communications module using a visible light wavelength of a lighting apparatus installed in and around residential, commercial or industrial spaces may control electronics, such as a television, a refrigerator, an air-conditioner, a door lock, or a vehicle.

The reflector 4310 and the communications module 4320 may be covered with a cover 4330.

As set forth above, according to various exemplary embodiments, the light emitting diodes (LEDs) may be orthogonally controlled, and the control module for the LEDs may be simplified. In addition, a negative impact on the control module depending on spatial restrictions on the LEDs may be reduced. Furthermore, as the LEDs in the lighting apparatus are free to be arranged, the lighting apparatus may control efficiently color temperature and/or luminous flux thereof.

While exemplary embodiments have been shown and described above, it will be apparent to those skilled in the art that modifications and variations could be made without departing from the scope of the present disclosure as defined by the appended claims.

What is claimed is:

1. A light emitting diode (LED) driving apparatus comprising:

a power supply circuit configured to supply driving power to a first LED group and a second LED group, the first LED group and the second LED group being configured to emit light having different color temperatures;

a current controlling circuit configured to control a first magnitude of a first current flowing through the first LED group and a second magnitude of a second current flowing through the second LED group; and an LED controller comprising a first common control switch configured to simultaneously change on/off switching operations of a first LED of the first LED group and a second LED of the second LED group and a second common control switch configured to simultaneously change on/off switching operations of a third LED of the first LED group and a fourth LED of the second LED group.

2. The light emitting diode (LED) driving apparatus of claim 1, wherein the current controlling circuit is further configured to receive a color temperature control signal, and to adjust the first magnitude and the second magnitude in accordance with the color temperature control signal.

3. The light emitting diode (LED) driving apparatus of claim 2, wherein the current controlling circuit comprises:

a first resistor electrically connected to the first LED group and a second resistor electrically connected to the second LED group; and a first transistor electrically connected to the first resistor and the first LED group and a second transistor electrically connected to the second resistor and the first LED group, the first transistor and the second transistor being configured to regulate the first current and the second current flowing through the first resistor and the second resistor in response to a control signal, wherein the current controlling circuit is further configured to determine a level of the control signal by comparing the first current and the second current to a current corresponding to the color temperature control signal.

4. The light emitting diode (LED) driving apparatus of claim 1, wherein the current controlling circuit comprises:

a current sensing circuit configured to sense the first current and the second current;

a control signal generating circuit configured to generate a first control signal based on the first current sensed by the current sensing circuit and a second control signal based on the second current sensed by the current sensing circuit; and a current regulating circuit configured to receive the first control signal and the second control signal, and regulate the first current in accordance with the first control signal and the second current in accordance with the second control signal.

5. The light emitting diode (LED) driving apparatus of claim 1, wherein the LED controller is further configured to receive a luminous flux control signal, and adjust a first luminous flux of the first LED group and a second luminous flux of the second LED group based on the luminous flux control signal.

6. The light emitting diode (LED) driving apparatus of claim 1, further comprising a first plurality of diodes electrically connected between the first LED group and the LED controller.

7. The light emitting diode (LED) driving apparatus of claim 1, wherein the LED controller is further configured to sequentially control a first plurality of LEDs included in the first LED group and a second plurality of LEDs included in the second LED group according to a corresponding order of the first plurality of LEDs and the second plurality of LEDs, and simultaneously adjust on/off switching operations of LEDs of the first LED group and the second LED group having an identical order.

8. The light emitting diode (LED) driving apparatus of claim 1, wherein a first quantity of a first plurality of LEDs is identical to a second quantity of a second plurality of LEDs, and the LED controller is further configured to adjust on/off switching operations of the first LED together with on/off switching operation of the second LED group.

9. A lighting apparatus comprising:

a light source comprising a first LED array and a second LED array of a plurality of LED arrays configured to emit light having different color temperatures, each of the plurality of LED arrays comprising a corresponding plurality of LEDs sequentially connected to each other in series;

a power supply circuit configured to rectify power received from an alternating current (AC) power source and supply driving power to the plurality of LED arrays;

a current controlling circuit configured to control a first magnitude of a first current flowing through a first array and a second magnitude of a second current flowing through the second LED array; and an LED controller comprising a first common control switch configured to simultaneously change on/off switching operations of a first LED of the first LED array and a second LED of the second LED array and a second common control switch configured to simultaneously change on/off switching operations of a third LED of the first LED array and a fourth LED of the second LED array.

10. The lighting apparatus of claim 9, further comprising a substrate on which the plurality of LED arrays are mounted.

11. The lighting apparatus of claim 9, wherein the first LED array is configured to emit light having one of a maximum color temperature, an intermediate color temperature, and a minimum color temperature; and the second LED array is configured to emit light having a first color temperature different from a second color temperature of the first LED array.

12. The lighting apparatus of claim 9, wherein the current controlling circuit comprises:

a current sensing circuit configured to sense the first current flowing through the first LED array and the second current flowing through the second LED array;

a control signal generating circuit configured to generate a first control signal based on the first current sensed by the current sensing circuit and a second control signal based on the second current sensed by the current sensing circuit; and a current regulating circuit configured to receive the first control signal and the second control signal, and regulate the first current in accordance with the first control signal and the second current in accordance with the second control signal.

13. The lighting apparatus of claim 9, wherein the first common control switch is further configured to simultaneously adjust on/off switching operations of the first LED and the second LED, and wherein the LED controller is further configured to receive a luminous flux control signal and control a first luminous flux of the first LED array and a second luminous flux of the second LED array based on the luminous flux control signal simultaneously.

14. The lighting apparatus of claim 9, further comprising a first plurality of diodes electrically connected between the first LED array and the LED controller.

15. A lighting apparatus comprising:

a first plurality of LEDs, the first plurality of LEDs comprising a first LED and a second LED electrically connected in series to the first LED;

a second plurality of LEDs, the second plurality of LEDs comprising a third LED and a fourth LED electrically connected in series to the third LED;

a plurality of transistors, the plurality of transistors comprising a first transistor and a second transistor, wherein the first transistor is configured to selectively connect a power source to a first output terminal of the first LED and a third output terminal of the third LED, and the second transistor is configured to selectively connect the power source to a second output terminal of the second LED and a fourth output terminal of the fourth LED.

16. The lighting apparatus of claim 15, further comprising a control circuit configured to generate a luminous flux control signal indicating a total current flowing through the first plurality of LEDs and the second plurality of LEDs.

17. The lighting apparatus of claim 16, wherein the first transistor and the second transistor are configured to turn on and turn off in accordance with the luminous flux control signal.

18. The lighting apparatus of claim 17, wherein the first transistor has a first turn-on voltage and the second transistor has a second turn-on voltage.

19. The lighting apparatus of claim 18, wherein the first turn-on voltage is greater than the second turn-on voltage.

* * * * *